US007441816B2

(12) United States Patent
Watanabe et al.

(10) Patent No.: US 7,441,816 B2
(45) Date of Patent: Oct. 28, 2008

(54) AUTOMOTIVE CHILDPROOF SAFETY LOCK CONTROL APPARATUS

(75) Inventors: Mitsuhiro Watanabe, Yamanashi (JP); Miki Ogino, Yamanashi (JP)

(73) Assignee: Mitsui Mining & Smelting Co., Ltd., Tokyo (JP)

( * ) Notice: Subject to any disclaimer, the term of this patent is extended or adjusted under 35 U.S.C. 154(b) by 137 days.

(21) Appl. No.: 11/455,780

(22) Filed: Jun. 20, 2006

(65) Prior Publication Data

US 2006/0290143 A1 Dec. 28, 2006

(30) Foreign Application Priority Data

Jun. 23, 2005 (JP) ..... 2005-183757
Jun. 23, 2005 (JP) ..... 2005-183758
Jun. 23, 2005 (JP) ..... 2005-183759

(51) Int. Cl.
*E05C 3/06* (2006.01)

(52) U.S. Cl. ..... 292/216; 70/279

(58) Field of Classification Search ..... 292/216, 292/201; 70/279
See application file for complete search history.

(56) References Cited

U.S. PATENT DOCUMENTS 5,605,363 A * 2/1997 Kapes ..... 292/196
5,667,259 A 9/1997 Torkowski
5,718,465 A * 2/1998 Dowling et al. ..... 292/216
5,921,594 A 7/1999 Bendel
6,135,513 A * 10/2000 Hamada et al. ..... 292/201
6,332,634 B1 * 12/2001 Fukumoto et al. ..... 292/201
6,386,599 B1 * 5/2002 Chevalier ..... 292/201
6,717,290 B2 * 4/2004 Hirota et al. ..... 307/10.2
6,722,714 B2 * 4/2004 Ooe et al. ..... 292/216
6,737,758 B2 5/2004 Weyerstall et al.
6,786,070 B1 * 9/2004 Dimig et al. ..... 70/277
6,923,479 B2 * 8/2005 Aiyama et al. ..... 292/201
7,048,314 B2 * 5/2006 Spurr ..... 292/216
7,293,806 B2 * 11/2007 Umino ..... 292/216
2005/0087994 A1 * 4/2005 Umino ..... 292/216

FOREIGN PATENT DOCUMENTS

DE 197 42 798 A 1 1/1998
DE 196 52 717 A 1 6/1998
DE 100 18 194 A 1 10/2001
DE 100 23 311 A 1 12/2001
EP 1 288 410 A3 3/2003
JP 11-166338 6/1999
JP 2005-138696 6/2005

* cited by examiner

*Primary Examiner*—Gary Estremsky
(74) *Attorney, Agent, or Firm*—Foley & Lardner LLP

(57) ABSTRACT

An automotive childproof safety lock control apparatus including a door latch which can hold a door of a vehicle in a closed position, a childproof safety lock unit which can be displaced to an unlocking state where the release of the door latch from a latching state is enabled by controlling an inner handle provided inside of the vehicle to open the door and a locking state where the release of the door latch from the latching state is disabled, and a drive unit which is linked to the childproof safety lock unit and the door latch so as to displace the childproof safety lock unit from the locking state to the unlocking state and release the door latch from the latching state when activated in one direction and to displace the childproof safety lock unit from the unlocking state to the locking state when activated in the other direction.

14 Claims, 12 Drawing Sheets

AUTOMOTIVE CHILDPROOF SAFETY LOCK CONTROL APPARATUS

This application is based on Japanese Patent Applications No. 2005-183757, 2005-183758 and 2005-183759, which are incorporated herein by reference.

BACKGROUND OF THE INVENTION

1. Field of the Invention

The present invention relates to an automotive childproof safety lock control apparatus including a childproof safety lock unit which can be displaced to an unlocking state where a release of a door latch from a latching state through a door opening control by an inner handle provided inside a vehicle can be enabled and a locking state where the release can be disabled.

The present invention also relates to an automotive door latch control apparatus which includes a lock unit which can be displaced to an unlocking state where the lock unit can transmit a door opening control force applied by a control handle provided on a door to a door lock and a locking state where the lock unit cannot transmit the door opening control force.

2. Description of the Related Art

In a control apparatus of a door latch provided on a rear side door of a vehicle, a childproof safety lock unit is provided which enables the opening of the rear side door by controlling an outer handle provided on an outside of the door in such a way as to open the door but disables the opening of the door by an inner handle provided on an inside of the door. This childproof safety lock unit is such as to prevent the door from being opened by particularly a child who mishandles or mischievously plays with the inner handle while the vehicle is running, and a controlling portion is hidden between the door and a body of the vehicle in such a state that the door is closed so as not to be operated while running (refer to, for example, JP-A-2005-138696).

Further, in an automotive door latch control apparatus, a so-called a double-action override control is known in which when a lock unit which can be displaced to an unlocking state where a door opening control force of a control handle provided on an inside of a door is made available and a locking position where the door opening control force is made unavailable is in the locking state, the lock unit is switched over from the locking state to the unlocking state through a first control of the control handle, and following this, a door latch is released from a latching state through a second control of the control handle to thereby open the door (for example, refer to JP-A-11-166338).

In the control apparatus disclosed in JP-A-2005-138696, however, the door needs to be opened to control the childproof safety lock unit. Due to this, in the event that the childproof safety lock unit is failed to be controlled into a locking state before the vehicle starts, the childproof safety lock unit cannot be put into the locking state once the vehicle has started running. In contrast, in the event that the childproof safety lock unit is in the locking state, since the door cannot be opened from the inside of the vehicle even when the vehicle is at rest, the driver gets out of the vehicle to open the door from the outside of the vehicle each time the door needs to be opened. Consequently, the driver and the occupants have to open and close the door while being conscious about the state of the childproof safety lock unit, and thus, the control apparatus has a problem that it is inconvenient for use.

Incidentally, this problem can be solved by designing such that power of an actuator that is made up of a motor or the like is used to control the childproof safety lock unit, as well as releasing the door latch from the latching state. However, when designed in such a way, there are necessary two actuators, one for controlling the childproof safety lock unit and the other for releasing the door latch from the latching state, producing another problem that an increase in production costs is called for.

Further, in the control apparatus disclosed in JP-A-11-166338 above, however, in order to release the door latch from the latching state when the lock unit is in the locking state, the control handle has to be controlled twice, and hence, the door cannot be opened quickly.

SUMMARY OF THE INVENTION

The invention was made in view of the problem and an object thereof is to provide an automotive childproof safety lock control apparatus in which the operability of the childproof safety lock unit is improved.

Further, the invention provides an automotive childproof safety lock control apparatus which enables both the control of the childproof safety lock unit and the release of the door latch from the latching state by a single drive unit, so that a reduction in production costs can be realized.

Further, the invention provides an automotive door latch control apparatus with which the door can be opened quickly when the lock unit is in the locking state.

According to the invention, the problem will be solved as below.

(1) According to a first aspect of the invention, there is provided an automotive childproof safety lock control apparatus including a first childproof safety lock unit which can be displaced to an unlocking state where the first childproof safety lock unit can transmit a door opening control force applied by an inner handle provided inside a vehicle and a locking state where the first childproof safety lock unit cannot transmit the door opening control force and a second childproof safety lock unit which can input thereinto a door opening control force transmitted from the first childproof lock unit when the first childproof safety lock unit is in the unlocking state and which can be displaced to an unlocking state where the second childproof safety lock unit can transmit the door opening control force which it has inputted thereinto to a door latch which holds a door in a closed position and a locking state where the second childproof safety lock unit cannot transmit the door opening control force, wherein either the first or second childproof safety lock unit is made to be displaced to the respective states by virtue of power of a drive unit, whereas the other is made to be manually displaced to the respective states.

(2) According to a second aspect of the invention, there is provided an automotive childproof safety lock control apparatus including a first childproof safety lock unit which can be displaced to an unlocking state where the first childproof safety lock unit can transmit a door opening control force applied by an inner handle provided inside a vehicle and a locking state where the first childproof safety lock unit cannot transmit the door opening control force and a second childproof safety lock unit which can input thereinto a door opening control force transmitted from the first childproof lock unit when the first childproof safety lock unit is in the unlocking state and which can be displaced to an unlocking state where the second childproof safety lock unit can transmit the door opening control force which it has inputted thereinto to a door latch which holds a door in a closed position and a locking state where the second childproof safety lock unit cannot transmit the door opening control force, a drive unit which can perform an unlocking drive and a locking drive to displace either the first or second childproof safety lock unit to the unlocking state and the locking state, respectively, a door opening control detecting unit which can detect an door opening control performed by the inner handle, and a control unit which executes a locking drive control of the drive unit based on a vehicle running signal and an unlocking drive control of the drive unit based on detection of the door opening control by the door opening control detecting unit, wherein the other of the first or second childproof safety lock unit is made to be manually displaced to the respective states.

(3) According to a third aspect of the invention, there is provided an automotive childproof safety lock control apparatus as set forth under (2) above, wherein the control unit does not execute the unlocking drive control of the drive unit while the vehicle running signal is being inputted.

(4) According to a fourth aspect of the invention, there is provided an automotive childproof safety lock control apparatus as set for thunder (2) or (3) above, wherein the control unit enables the unlocking drive control of the drive unit while a vehicle stop signal is being inputted thereinto.

(5) According to a fifth aspect of the invention, there is provided an automotive childproof safety lock control apparatus as set forth under any of (2) to (4) above, wherein the control unit does not execute the unlocking drive control of the drive unit while a locking state detection signal of either the first or second childproof safety lock unit is being inputted, even in the event that the vehicle running signal is inputted thereinto. (6) According to a sixth aspect of the invention, there is provided an automotive childproof safety lock control apparatus including a door latch which can hold a door of a vehicle in a closed position, a childproof safety lock unit which can be displaced to an unlocking state where the release of the door latch from a latching state is enabled by controlling an inner handle provided inside of the vehicle to open the door and a locking state where the release of the door latch from the latching state is disabled, and a drive unit which is linked to the childproof safety lock unit and the door latch in such a manner as to displace the childproof safety lock unit from the locking state to the unlocking state and release the door latch from the latching state when activated in one direction and to displace the childproof safety lock unit from the unlocking state to the locking state when activated in the other direction.

(7) According to a seventh aspect of the invention, there is provided an automotive childproof safety lock control apparatus as set forth under (6) above, wherein when the childproof safety lock unit is in the unlocking state, the drive unit is activated in the one direction as the inner handle is controlled to open the door.

(8) According to an eighth aspect of the invention, there is provided an automotive door latch control apparatus including a lock unit which can be displaced to an unlocking state where the lock unit can transmit a door opening control force applied by a control handle provided on a door to a door latch and a locking state where the lock unit cannot transmit the door opening control force, wherein the door latch is made to be released from a latching state by power of a drive unit which can be driven as the control handle is controlled to open the door at substantially the same time as the lock unit is displaced from the locking state to the unlocking state.

(9) According to a ninth aspect of the invention, there is provided an automotive door latch control apparatus as set forth under (8) above, wherein the lock unit has an input lever which can input thereinto the door opening control force of the control handle, an output lever which is linked to the door latch, a connecting unit which can move to a connecting position where the connecting unit can transmit the door opening control force that the input lever has inputted thereinto to the output lever and a cutting-off position where the connecting unit cannot transmit the door opening control force, and a lock lever which can be moved by power of a drive unit to an unlocking position where the connecting unit can be held in the connecting position and a locking position where the connecting unit is held in the cutting-off position, whereby when the door opening control force is inputted into the input lever in such a state that the lock lever is in the locking position and the connecting unit is in the cutting-off position, the lock lever is moved to the unlocking position against a biasing force exerted between the connecting unit and the lever by power of the drive unit with the connecting unit held in the cutting-off position, and when the door opening control force is removed, the connecting unit is moved to the connecting position by the biasing force, so that the lock unit is displaced to the unlocking state.

According to the invention, the following advantages are provided.

(a) According to the first aspect of the invention, since either the first or second childproof safety lock unit can be displaced to the respective states by means of the drive unit, the door does not have to be opened every time the childproof safety lock is controlled, thereby making it possible to improve the controllability of the childproof safety lock control apparatus. In addition, since the other of the first or second childproof safety lock unit can be manually controlled, not only can the controllability of the apparatus be enhanced but also the manual control with small force becomes possible without being subjected to resistance resulting when the drive unit is reversed.

(b) According to the second aspect of the invention, since either the first or second childproof safety lock unit is displaced to the locking state based on the vehicle running signal and is displaced to the unlocking state based on the control of the inner handle to open the door, the childproof safety lock control can be effected without having to make the driver and occupants feel conscious about the childproof safety lock control, thereby making it possible to enhance the convenience of the apparatus. In addition, since the failure to control the childproof safety lock can be eliminated, the safety can be secured.

(c) According to the third aspect of the invention, since the drive unit does not perform the unlocking drive while the vehicle is running, the enhancement in safety can be realized.

(d) According to the fourth aspect of the invention, since the drive unit can be made to perform the unlocking drive when the vehicle is at rest, the improvement in controllability of the apparatus can be realized while securing safety.

(e) According to the fifth aspect of the invention, the drive unit is not made to perform the locking drive uselessly while the vehicle is running.

(f) According to the sixth aspect of the invention, by linking the drive unit to the childproof safety lock unit and the door latch in such a manner that not only is the childproof safety lock unit displaced from the locking state to the unlocking state but also the door latch is released from the latching state by activating the drive unit in the one direction, whereas by activating the drive unit in the other direction, the childproof safety lock unit is displaced from the unlocking state to the locking state, both the control of the childproof safety lock unit and the release of the door latch from the latching state can be completed by the single drive unit, thereby making it possible to realize a reduction in production costs.

(g) According to the seventh aspect of the invention, not only can the childproof safety lock unit be displaced from the locking state to the unlocking state but also the door latch can be released from the latching state as the inner handle is controlled to open the door.

(h) According to the eighth aspect of the invention, when the lock unit is in the locking state, the displace of the lock unit to the unlocking state and the release of the door latch from the latching state can be completed at substantially the same time through a single control of the control handle to open the door, so that the door can be opened quickly.

(i) According to the ninth aspect of the invention, the respective levers of the lock unit can be prevented from interfering with each other, so that the displacement of the lock unit by the drive unit from the locking state to the unlocking state can be ensured.

DETAILED DESCRIPTION OF THE PREFERRED EMBODIMENTS

Figure 1:
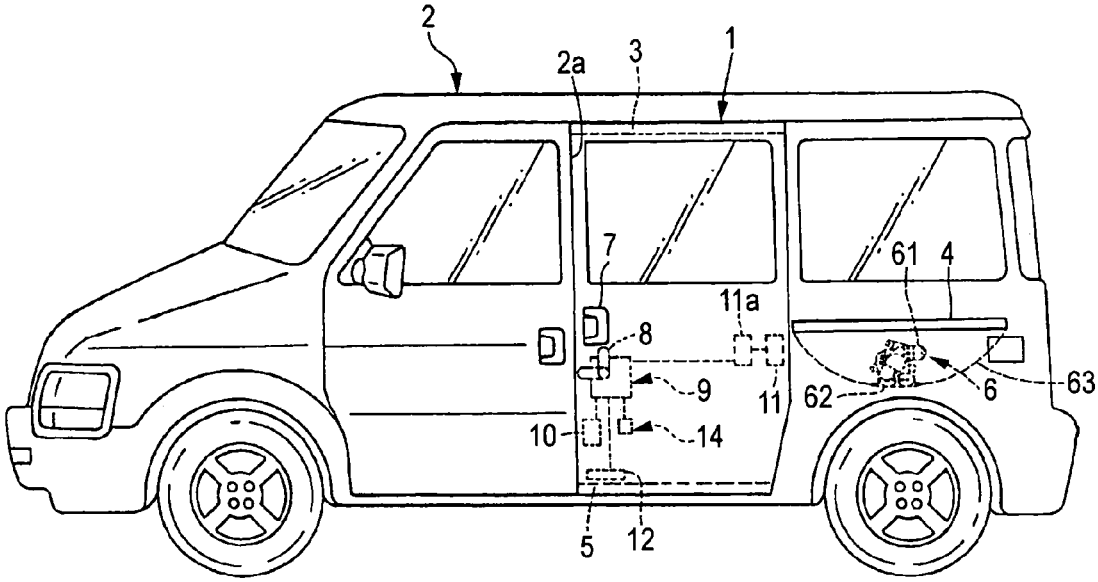
FIG. 1 is a side of a vehicle to which an embodiment of the invention is applied.
Figure 2:
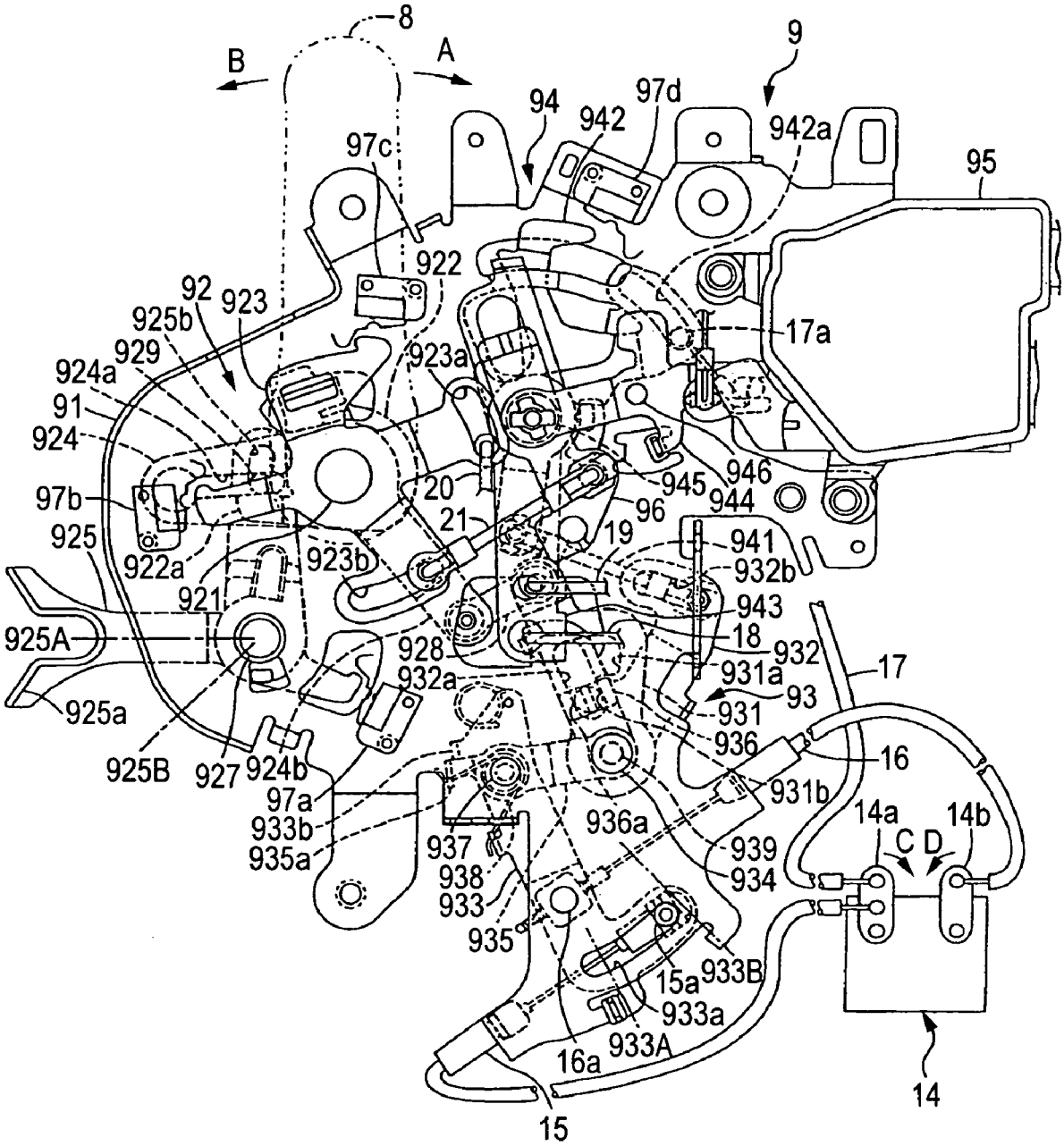
FIG. 2 is a side view of a drive unit.
Figure 3:
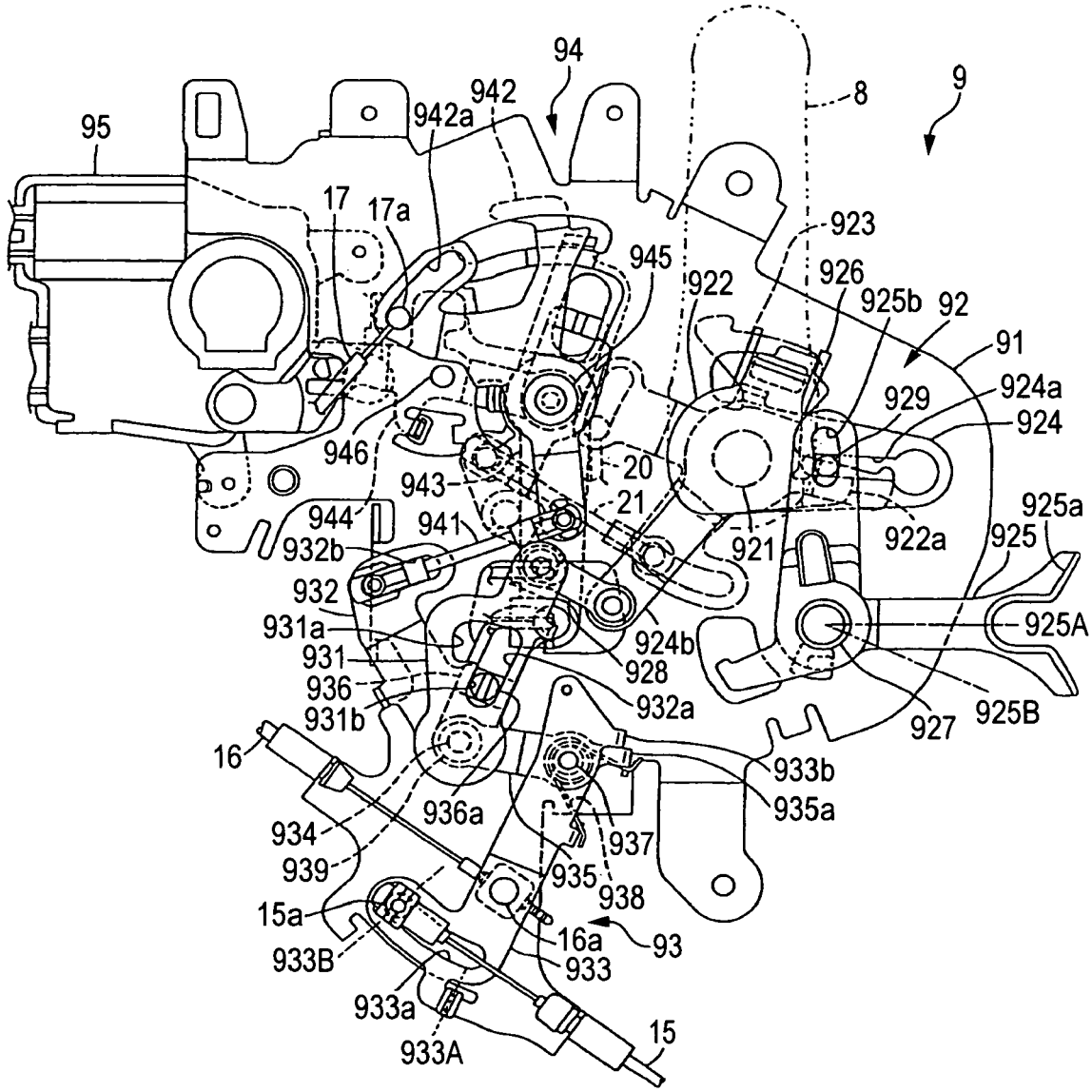
FIG. 3 is a backside view of the drive unit.

Hereinafter, an embodiment of the invention will be described based on the drawings. FIG. 1 is a side view of a vehicle to which the invention is applied, FIG. 2 is a side view of a control unit, FIG. 3 is a backside view of the control unit, and FIGS. 4 to 10 are control unit operation explaining drawings which show respective states of the unit. In a description which will be made below, the left in FIGS. 1, 2 and 4 to 10 and the right in FIG. 3 are regarded as facing the "front" of the vehicle, and the right in FIGS. 1, 2 and 4 to 10 and the left in FIG. 3 are regarded as facing the "rear" of the vehicle.

As shown in FIG. 1, a rear side sliding door (1) for a rear seat of a minivan or station wagon type of vehicle is supported in such a manner as to be moved to open from a totally closed position where the door closes an ingress and egress opening (2*a*) provided in a side of a body (2) to a totally opened position resulting when the door is totally moved rearwards along the side of the body (2) while being moved slightly outwards from an outside surface of the body (2) along guide rails (3), (4), (5) provided on the side of the body (2) and to be moved in a reverse direction to close.

An outer handle (7) is provided on an outside of the sliding door (1) which is operated when the sliding door (1) is opened or closed from the outside of the vehicle, and similarly, an inner handle (8) is provided on an inside of the sliding door (1) which is operated when the sliding door (1) is opened or closed from the inside of the vehicle.

A door opening/closing drive unit (6) is provided inside of a rear panel of the body (2) which moves the sliding door (1) to open or close by virtue of power of a motor. The door opening/closing drive unit (6) has a motor (61) which can rotate normally and reversely, a rotary drum (62) which can rotate by virtue of power of the motor (61), and a cable (63) which is connected to a rear end portion of the sliding door (1) and is passed around the rotary drum (62) in such a manner as to be wound around and fed out of the rotary drum (62), whereby the rotary drum (62) is rotated in a predetermined direction by the power of the motor (61) so that the cable (63) is wound around the rotary drum (62), so as to move the sliding door (1) in an opening direction or a closing direction. Note that the motor (61) is controlled to be driven by a control circuit unit (100), which will be described later on, installed at an appropriate location on the body (2).

Provided in an interior of the sliding door (1) are a front total closing door latch (10) and a rear total closing door latch (11) which are brought into engagement with strikers (not shown) provided on the body (2) side to hold the sliding door (1) in the totally closed (stopped) position, a total opening latch (12) which is brought into engagement with a striker (not shown) provided on the body (2) side to hold the sliding door (1) in the totally opened position, a control unit (9) which can input thereinto control forces applied by the outer handle (7) and the inner handle (8) and transmit the control forces that it has inputted thereinto to the total closing door latches (10), (11) and the total opening latch (12), respectively, and a first actuator (14) which makes up a drive unit which displaces the control unit (9) to respective states, which will be described later on, by virtue of the power of the motor. Note that the rear total closing door latch (11) has a known door closer (11*a*) which is adapted to forcibly move the sliding door (1) from a half-locked state to a totally closed state by virtue of the power of the motor.

As shown mainly in FIG. 2, the inner handle (8) is normally held in a neutral position and releases the respective total closing door latches (10), (11) from latching states when operated or controlled from the neutral position in a door opening direction (a direction indicated by an arrow A in FIG. 2), so that the sliding door (1) can be opened from the totally closed position, whereas when operated from the neutral position in a door closing direction (a direction indicated by an arrow B in FIG. 2), the inner handle (8) releases the total opening latch (12) from a latching state, so that the sliding door (1) can be closed from the totally opened position.

The first actuator (14) includes a normally and reversely rotatable motor (141) (refer to FIGS. 11, 12) which is controlled by the control circuit unit (100) which makes up a control unit and rotates an unlocking release lever (14*a*) in a direction indicated by an arrow C in FIG. 2 when the motor (141) rotates normally, whereas when the motor (141) rotates reversely, the first actuator 14 rotates a locking lever (14*b*)in a direction indicated by an arrow D in FIG. 2.

As shown mainly in FIGS. 2, 3, the control unit (9) includes on a base plate (91) fixed to an inner panel of the sliding door (1) a first childproof safety lock unit (92) which can be manually displaced to an unlocking state where a door operating control of the inner handle (8) is made available and a locking state where the same door operating control is made unavailable, a second childproof safety lock unit (93) which can be displaced by virtue of power of the first actuator (14) to an unlocking state where the door opening control of the inner handle (8) is made available and a locking state where the same door opening control is made unavailable, when the first childproof safety lock unit (92) is in the unlocking state, a locking/unlocking unit (94) which can be displaced to an unlocking state where the door opening controls of the inner handle (8) and the outer handle (7) are made available and a locking state where the same door opening controls are made unavailable, when both the first and second childproof safety lock units (92), (93) are in the unlocking states, a second actuator (95) which displaces the locking/unlocking unit (94) to the respective states by virtue of power of a motor, and a cancellation lever (96) which is connected to the door closer (11*a*).

The cancellation lever (96) is pivotally supported on the base plate (91) by a pivot shaft (945) and activates a cancellation mechanism (not shown) provided on the door closer (11*a*) via a connecting member (not shown) such as a cable when rotating from a waiting position (for example, refer to FIG. 2) in a canceling direction (in a clockwise direction in FIG. 2). The cancellation mechanism cuts off connection between the door closer (11*a*) and the rear total closing door latch (11) so as to cancel a fastening operation by the door closer (11*a*) in which the sliding door (1) is fastened from the half-locked state to the totally closed position.

The first childproof safety lock unit (92) has an input shaft (921) which is pivotally secured to the base plate (91) and to an inboard end portion of which the inner handle (8) is fixedly secured, a first input lever (922) and a fail-safe lever (923) which can rotate together with the inner handle (8), a first output lever (924) which can transmit door opening control force of the inner handle (8) to the second childproof safety lock unit (93) when in the unlocking state, a first childproof safety lock lever (925) which can be moved to an unlocking position (925A) and a locking position (925B) by virtue of a manual control, a first childproof safety lock detection sensor (97*a*) which can detect the respective positions of the first childproof safety lock lever (925), a door opening control detection sensor (97*b*) which can detect a door opening operation (in the clockwise direction FIG. 2) of the first output lever (924) and a door closing control detection sensor (97*c*) which can detect an operation of the fail-safe lever (923) in a door closing direction (a counterclockwise direction in FIG. 2).

The first input lever (922) is pivotally supported via the input shaft (921) on a rearward side of the base plate (91) in such a manner as to rotate together with the inner handle (8) and is held in the neutral position (FIGS. 2, 3, 5 and 9) together with the inner handle (8) by a spring (926) (refer to FIG. 3) wound round the input shaft (921), whereby when the inner handle (8) is controlled to open the door (in the direction indicated by the arrow A), the first input lever (922) rotates from the neutral position in the door opening direction (in the clockwise direction in FIG. 2) against biasing force of the spring (926). In addition, an engagement portion (922*a*) is provided on the first input lever (922) in such a manner as to protrude forwards.

The fail-safe lever (923) is pivotally supported via the input shaft (921) on a forward side of the base plate (91) in such a manner as to rotate together with the inner handle (8) and can rotate together with the inner handle (8) from the neutral position in the door opening direction (the clockwise direction in FIG. 2) and the door closing direction (the counterclockwise direction in FIG. 2).

A first connecting portion (923*a*), which is formed into an elongate hole and which is connected to the total opening latch (12) via a cable (20), and a second connecting portion (923*b*), which is formed into an elongate hole and which is connected to the cancellation lever (96) via a lateral link (21), are provided in the fail-safe lever (923). When the fail-safe lever (923) rotates in the door opening direction, the cancellation lever (96) is rotated in a canceling direction via the link (21), whereas when rotating in the door closing direction, the total opening latch (12) is released from a latching state via the cable (20), whereby an engagement thereof with the striker is released.

The first output lever (924) is pivotally supported by the input shaft (921) on the rearward side of the base plate (91) in such a manner as to rotate independently from the first input lever (922) and the fail-safe lever (923), and a longitudinal elongate hole (924*a*) is provide at a front portion of the first output lever (924) and an arm portion (924*b*) is provided at lower portion thereof in such a manner as to be connected to a second input lever (931), which will be described later on, of the second childproof safety lock unit (93) via a longitudinal link (928). A sliding pin (929), which can move based on the control of the first childproof safety lock lever (925), is loosely fitted in the elongate hole (924*a*) in such a manner as to slide therein.

The first childproof safety lock lever (925) is pivotally supported on the rearward side of the base plate (91) by a pivot shaft (927) and is moved to the unlocking position (925A) and the locking position (925B) to thereby be held in the respective positions when a manual control portion (925*a*) provided at a front portion thereof is manually controlled.

A vertical elongate hole (925*b*), in which the sliding pin (929) is loosely fitted, is provided at an upper portion of the first childproof safety lock lever (925). The manual control portion (925*a*) is exposed from a front end face of the sliding door (1) and can be controlled when the sliding door (1) is opened but is hidden so as not to be controlled when the door is closed.

When the first childproof safety lock lever (925) is in the unlocking position (925A) (for example, refer to FIG. 2), the sliding pin (929) is situated at a rear end portion of the elongate hole (924*a*) of the first output lever (924) and is then in such a state that the sliding pin (929) is can be brought into engagement with the engagement portion (922*a*) of the first input lever (922) in a clockwise direction. In this state, when the first output lever (924) rotates in the door opening direction based on the door opening control (in the direction indicated by the arrow A) of the inner handle (8), the engagement portion (922*a*) is brought into engagement with the sliding pin (929), whereby the first output lever (924) can be rotated, for example, from the neutral position shown in FIG. 2 to the door opening direction (the clockwise direction).

In addition, when the first childproof safety lock lever (925) is in the locking position (925B) (for example, refer to FIG. 9), the sliding pin (929) is situated at a front end portion of the elongatehole (924*a*) and is in such a state that the sliding pin (929) is not allowed to be brought into engagement with the engagement portion (922*a*) of the first input lever (922). Consequently, in this state, even in the event that the first input lever (922) rotates from the neutral position in the door opening position based on the door opening control (in the direction indicated by the arrow A) of the inner handle (8), since the engagement portion (922*a*) is not brought into engagement with the sliding pin (929), the first output lever (924) cannot be rotated in the door opening direction.

Note that the state in which the first childproof safety lock lever (925) is in the unlocking position (925A) is defined as an unlocking state of the first childproof safety lock unit (92), and the state in which the first childproof safety lock lever (925) is in the locking position (925B) is defined as a locking state of the first childproof safety lock unit (92).

The second childproof safety lock unit (93), which makes up the lock unit, has a second input lever (931) (input lever) which is connected to the first output lever (924) via the link (21) and which can input the door opening control force outputted from the first output lever (924), a second output lever (932) (output lever) which can transmit the door opening control force that the second input lever (931) has inputted to a third input lever (942), which will be described later on, of the locking/unlocking unit (94) and the respective total closing door latches (10), (11) via the locking/unlocking unit (94) when in an unlocking state, and a second childproof safety lock lever (933) (lock lever) which can be moved to an unlocking position (933A) and a locking position (933B) by power of the first actuator (14).

The second input lever (931) and the second output lever (932) are pivotally supported on the rearward side of the base plate (91) by a pivot shaft (934) in such a manner as to rotate independently from each other.

The second input lever (931) rotates from a waiting position (FIGS. 2, 3, 5, 9 and 10) in a door opening direction (for example, in the counterclockwise direction in FIG. 2) as the first output lever (924) of the first childproof safety lock unit (92) rotates from the neutral position in the door opening direction. An arc-shaped hole portion (931*a*) which centers at the pivot shaft (934) and a rectilinear hole portion (931*b*) which provided continuously to a front end of the arc-shaped hole portion (931*a*) and which extends downwards are provided in the second input lever (931).

The second output lever (932) has a vertical elongate hole (932*a*) which overlaps the arc-shaped hole portion (931*a*) and the rectilinear hole portion (931*b*) of the second input lever (931), and an end portion of a link (941) connected to the third input lever (942) of the locking/unlocking unit (94) is loosely fitted in a lateral elongate hole (932*b*) which is provided at an upper portion of the second output lever (932).

An engagement portion (936*a*) of a second connecting lever (936) which can move as the second childproof safety lock lever (933) moves is loosely fitted in the arc-shaped hole portion (931*a*) and the rectilinear hole portion (931*b*) of the second input lever (931) and the elongate hole (932*a*) of the second output lever (932) in such a manner as to slide therein, the engagement portion (936*a*) of the second connecting lever (936) being described later on.

The second childproof safety lock lever (933) is pivotally supported on the rearward side of the base plate (91) by a pivot shaft (937), and a connecting portion (15*a*) of a cable (15) connected the unlocking release lever (14*a*) of the first actuator (14) is loosely fitted in an arc-shaped elongate hole (933*a*) provided at a lower end portion of the second childproof safety lock lever (933) from the front in such a manner as to slide therein, while a connecting portion (16*a*) of a cable (16) connected to the locking lever (14*b*) of the first actuator (14) is connected to the second childproof safety lock lever (933) at a position above the elongate hole (933*a*).

A first connecting lever (935) is pivotally supported on the pivot shaft (937) which pivotally supports the second childproof safety lock lever (933) in such a manner as to rotate independently from the second childproof safety lock lever (933) The first connecting lever (935) is biased, for example, in the clockwise direction as viewed in FIG. 2 relative to the second childproof safety lock lever (933) by means of a spring (938) wound round the pivot shaft (937) and is normally held in a position (refer to FIGS. 2 to 6, 9 and 10) where an abutment portion (935*a*) is in abutment with a bent piece (933*b*) of the second childproof safety lock lever (933).

A lower portion of the second connecting lever (936) is rotatably connected to a rear end portion of the first connecting lever (935) by a pivot shaft (939). The engagement portion (936*a*) of the second connecting lever (936) is, as has been described previously, loosely fitted in the arc-shaped hole portion (931*a*) and the rectilinear hole portion (931*b*) of the second input lever (931) and the elongate hole (932*a*) of the second output lever (932) in such a manner as to slide therein.

Note that while the connecting means of the invention is made up of the first and second connecting levers (935), (936), the connecting means may be made to be made up of either of the first and second connecting levers (935), (936).

When the second childproof safety lock lever (933) is in the unlocking position (933A), in the second connecting lever (936), the engagement portion (936*a*) is held in a connecting position where the engagement portion (936*a*) is situated at a lower end portion of the rectilinear hole portion (931*b*) of the second input lever (931) to thereby connect the second input lever (931) and the second output lever (931) together (refer to FIGS. 2 to 4, 9 and 10). Accordingly, when the second input lever (932) inputs thereinto the door opening control force of the inner handle (8) and rotates in a door opening direction (the counterclockwise direction in FIG. 2) from a waiting position (for example, refer to FIG. 2), the second output lever (932) is brought into engagement with the engagement portion (936*a*) of the second connecting lever (936) in association with the rotation of the second input lever (931), so as to rotate in the door opening direction together with the second input lever (931), whereby a door opening control force of the second output lever (932) is transmitted to the respective total closing door latches (10), (11) via the locking/unlocking unit (94).

In addition, when the second childproof safety lock lever (933) is in the locking position (933B), in the second connecting lever (936), the engagement portion (936*a*) is held in a cutting-off position (refer to FIG. 5) where the engagement portion (936*a*) is situated at a front end of the arc-shaped hole portion (931*a*) of the second input lever (931), and in there the connecting relationship between the second input lever (931) and the second output lever (932) is cut off. Accordingly, even in the event that the second input lever (931) rotates in a door opening direction, the engagement portion (936*a*) of the second connecting lever (936) only moves relatively rearwards within the arch-shaped hole portion (931*a*) (refer to FIG. 6), and the door opening operation of the second input lever (931) cannot be transmitted to the second output lever (932).

Note that a state where the second childproof safety lock lever (933) is in the unlocking position (933A) and the second connecting lever (936) is in the connecting position is defined as an unlocking state of the second childproof safety lock unit (93), and a state where the second childproof safety lock lever (933) is in the locking position (933B) and the second connecting lever (936) is in the cutting-off position is defined as a locking state of the second childproof safety lock unit (93).

The locking/unlocking unit (94) has the third input lever (942) which is connected to the second output lever (932) of the second childproof safety lock unit (93) via the link (941), a third output lever (943) which can output the door opening control force that the third input lever (942) has inputted to the respective total closing door latches (10), (11), a locking/unlocking lever (944) can be moved to an unlocking position (refer to the respective drawings) and a locking position which rotates over a predetermined amount in the clockwise direction in FIGS. 2, 4 to 10 from the unlocking position by virtue of a manual control of a locking/unlocking control knob (not shown) provided on the inside of the sliding door (1), and a latch release detection sensor (97*d*) which can detect the operation of the third input lever (942).

The third input lever (942) is pivotally supported on the rearward side of the base plate (91) by the pivot shaft (945), the third output lever (943) is pivotally supported on the forward side of the base plate (91) by the pivot shaft (945), and the locking/unlocking lever (944) is pivotally supported on the forward side of the base plate (91) by a pivot shaft (946).

The third input lever (942) is connected to the second outlet lever (932) of the second childproof safety lock unit (93) via the link (941) at a lower end portion thereof, and a connecting portion (17*a*) of a cable (17) connected to the unlocking release lever (14*a*) of the first actuator (14) and a cable (not shown) connected to the outer handle (7) are connected to an arc-shaped elongate hole (942*a*) provided at a rear end portion of the third input lever (942).

The third input lever (942) rotates from awaiting position (FIGS. 2, 3, 5, 6, 9 and 10) to a latch release position (FIGS. 4, 7 and 8) based on an operation of the second output lever (932) of the second childproof safety lock unit (93) in the door opening direction and operation of the unlocking release lever (14*a*) of the first actuator (14).

The third output lever (943) is connected to the respective total closing door latches (10), (11) via cables (18), (19) at a lower end portion thereof.

When in the unlocking position, the locking/unlocking lever (944) connects together the third input lever (942) and the third output lever (943) so that the door opening operation of the third input lever (942) is transmitted to the third output lever (943), and when in the locking position, the locking/unlocking lever (944) cuts off the connection between the third input lever (942) and the third output lever (943) so that the door opening operation of the third input lever (942) is not transmitted to the third output lever (943). Consequently, when the locking/unlocking lever (944) is in the locking position, the door opening controls of the outer handle (7) and the inner handle (8) are made unavailable regardless of the states of the first childproof safety lock unit (92) and the second childproof safety lock unit (93), whereby the sliding door (1) cannot be opened.

Figure 11:
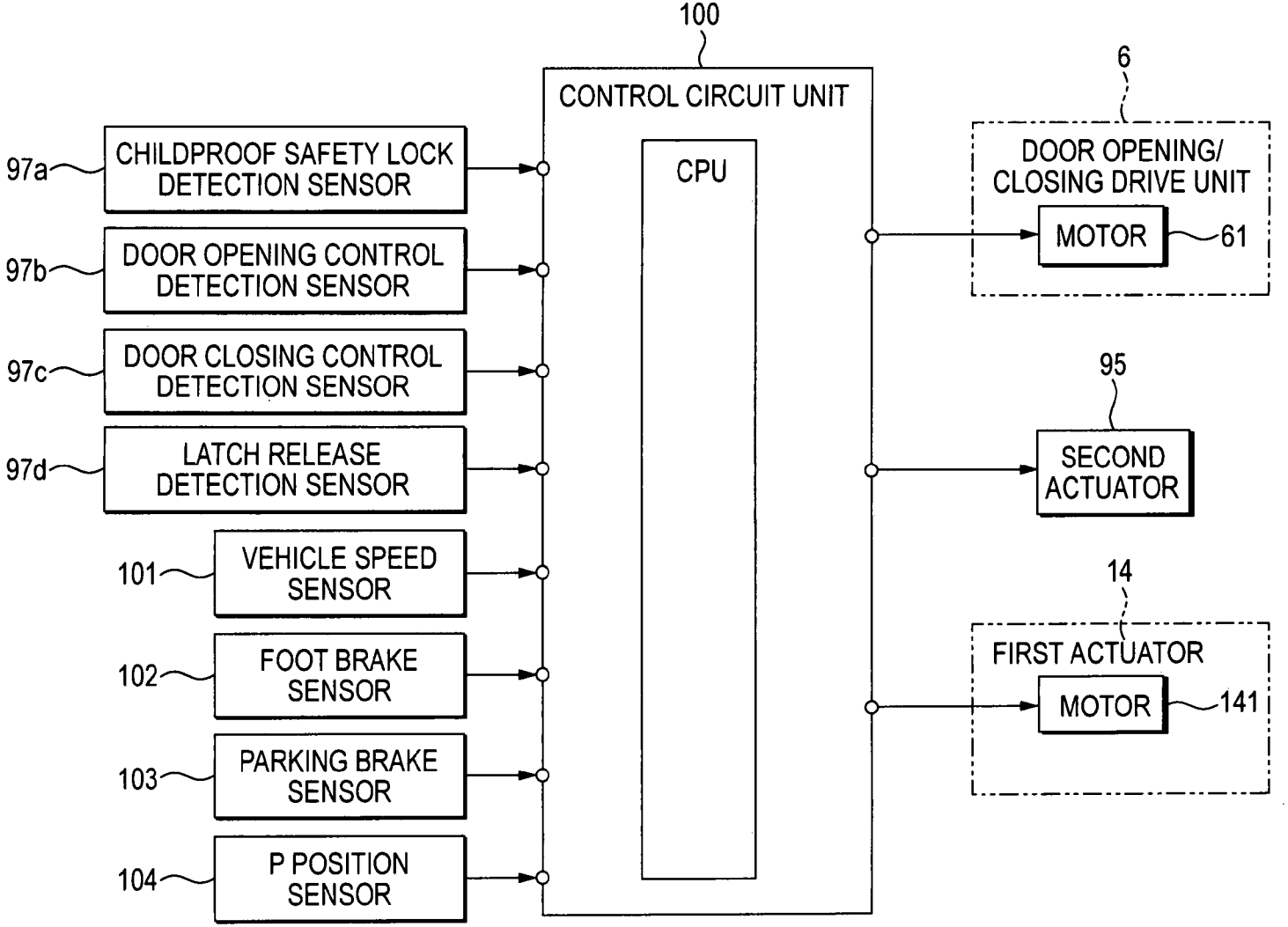
FIG. 11 is a block diagram which shows a control circuit.

Next, a control circuit will be described based on FIG. 11. The control circuit unit (100) which makes up a control unit is configured to include a CPU (central processing unit) which executes a series of control processes according to programs stored therein in advance, a ROM (read only memory) in which the programs and data are stored and a RAM (random access memory) which functions as a work area of the CPU, and connected to an input interface thereof are the childproof safety lock detection sensor (97*a*), the door opening control detection sensor (97*b*), a door closing control detection sensor (97*c*), the latch release detection sensor (97*d*), a vehicle speed sensor (101) which detects the running of the vehicle, a foot brake sensor (102) which detects the operation of a foot brake (not shown), a parking brake sensor (103) which detects the operation of a parking brake and a P position sensor (104) which detects that a gearshift lever is in a parking (P) position. In addition, connected to an output interface of the control circuit unit (100) are the motor (61) of the door opening/closing unit (6), the motor (141) of the first actuator (14), and a motor (not shown) of the second actuator (95). Thus, the control circuit unit (100) executes a locking drive control which rotates the motor (141) of the first actuator (14) in the reverse direction based on a vehicle running signal and an unlocking drive control which rotates the motor (141) in the normal direction.

When detecting the unlocking position of the first childproof safety lock lever (925), the childproof lock detection sensor (97*a*) outputs a HIGH signal (a childproof safety lock unlocking signal) and outputs a LOW signal (a childproof safety lock locking signal) when detecting the locking position of the lever.

The door opening control detection sensor (97*b*) outputs a HIGH signal (a door opening control signal) when it detects the rotation of the first output lever (924) in the door opening direction and output a LOW signal on other occasions.

The door closing control detection sensor (97*c*) outputs a HIGH signal (a door closing control signal) when it detects the rotation of the fail-safe lever (923) in the door closing direction in association with the door closing control of the inner handle (8) and outputs a LOW signal on other occasions.

The latch release detection sensor (97*d*) outputs a HIGH signal (a latch releasing signal) when it detects the operation of the third input lever (942) in the door opening direction and outputs a LOW signal on other occasions.

Next, the control by the control circuit unit (100) will be described by reference to a time chart shown in FIG. 12.

Figure 12:
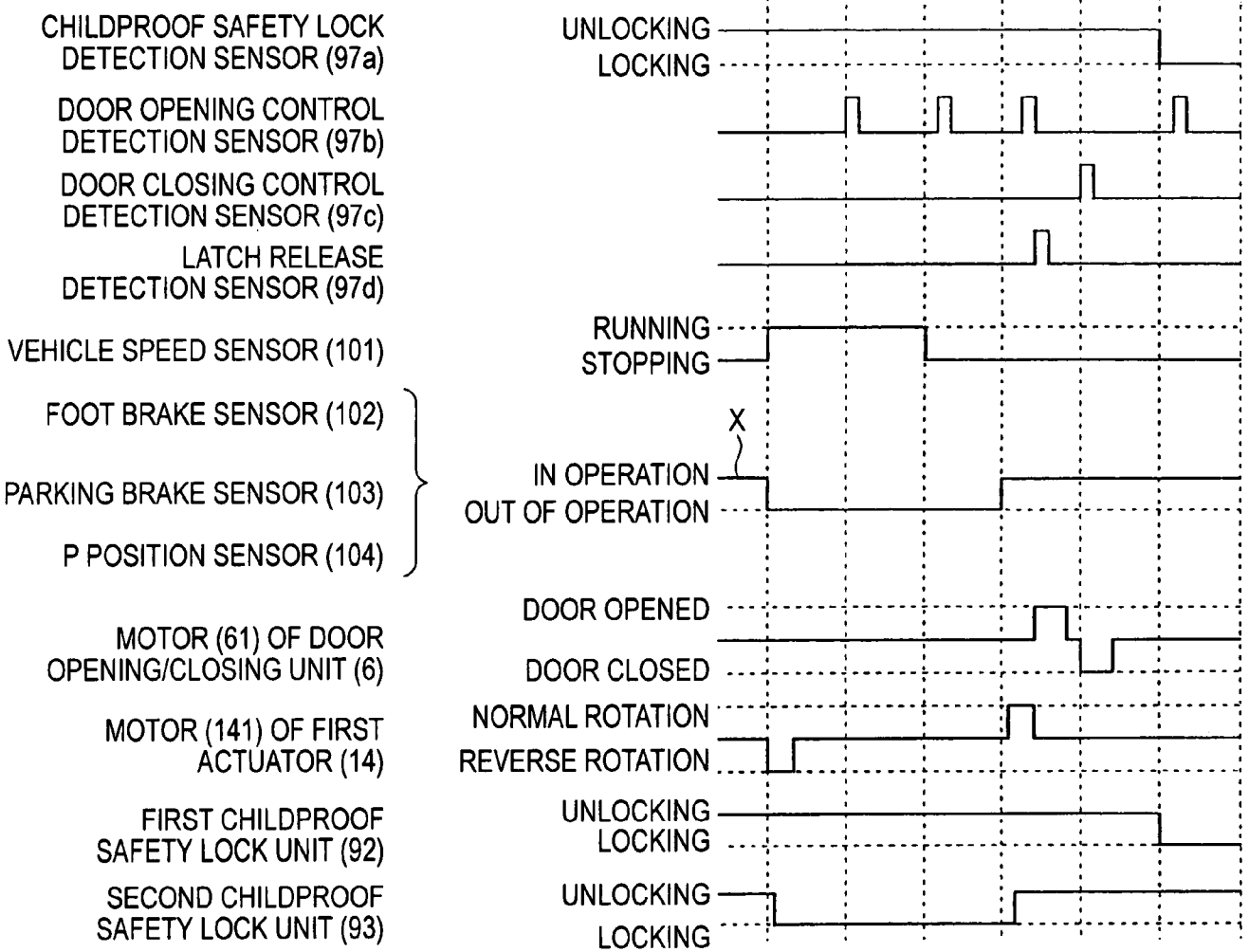
FIG. 12 is a drawing which shows a time chart.

As shown in a region (a) in FIG. 12, when an output signal of the vehicle speed sensor (101) becomes HIGH (in other words, when the vehicle starts running), with an output signal of the childproof safety lock detection sensor (97*a*) being HIGH, the motor (141) of the first actuator (14) is controlled to be driven to rotate reversely (in a direction in which the locking lever (14*b*) is put into operation).

As shown in a region (b), when the output signal of the vehicle speed sensor (101) is HIGH, even in the event that an output signal of the door opening control detection sensor (97*b*) becomes HIGH, the motor (141) of the first actuator (14) is not controlled to be driven.

As shown in a region (c), when the output signal of the vehicle speed sensor (101) is LOW (in other words, when the vehicle is at rest) and a vehicle stop signal (x) is LOW (when signal from the foot brake sensor (102), the parking brake sensor (103) or the P position sensor (104) are LOW), even in the event that a signal from the door opening control detection sensor (97*b*) becomes HIGH, the motor (141) of the first actuator (14) is not controlled to be driven.

As shown in a region (d), when the output signal of the vehicle speed sensor (101) is LOW and the vehicle stop signal (x) is HIGH (the output signal of the foot brake sensor (102), the parking brake sensor (103) or the P position sensor (104) is HIGH), when the output signal of the door opening control detection sensor (97*b*) becomes HIGH, the motor (141) of the first actuator (14) is controlled to be driven to rotate normally (in a direction in which the unlocking lever (14) is put into operation). Following this, when the output signal of the latch release detection sensor (97*d*) becomes HIGH (in other words, when the third input lever (942) rotates in the door opening direction), the motor (61) of the door opening/closing drive unit (6) is controlled to be driven to rotate normally (in the door opening direction of the sliding door (1)).

As shown in a region (e), when the signal of the door closing control detection sensor (97*c*) becomes HIGH, the motor (61) of the door opening/closing drive unit (6) is controlled to be driven to rotate reversely (in the door closing direction of the sliding door (1)).

As shown in a region (f), with the output signal of the childproof safety lock detection sensor (97*a*) being LOW (in other words, when the first childproof safety lock unit (92) is in the locking state), even in the event that the output signal of the door opening control detection sensor (97*b*) becomes HIGH, the motor (141) of the first actuator (14) is not controlled to be driven.

Next, operations in the respective states according to the invention will be described. Note that in all of the following states, the locking/unlocking unit (94) is in the unlocking state.

(A. A case the first childproof safety lock unit (92) and the second childproof safety lock unit (93) are both in the unlocking states with the vehicle being at rest (refer to FIGS. 2 to 4 and the region (d) in FIG. 12))

In the state shown in FIGS. 2, 3, when the inner handle (8) is controlled in the door opening direction (the direction indicated by the arrow A), the control force thereof is inputted into the first input lever (922) of the first childproof safety lock unit (92) and is then transmitted from the first output lever (924) to the second input lever (931) of the second childproof safety lock unit (93).

Figure 4:
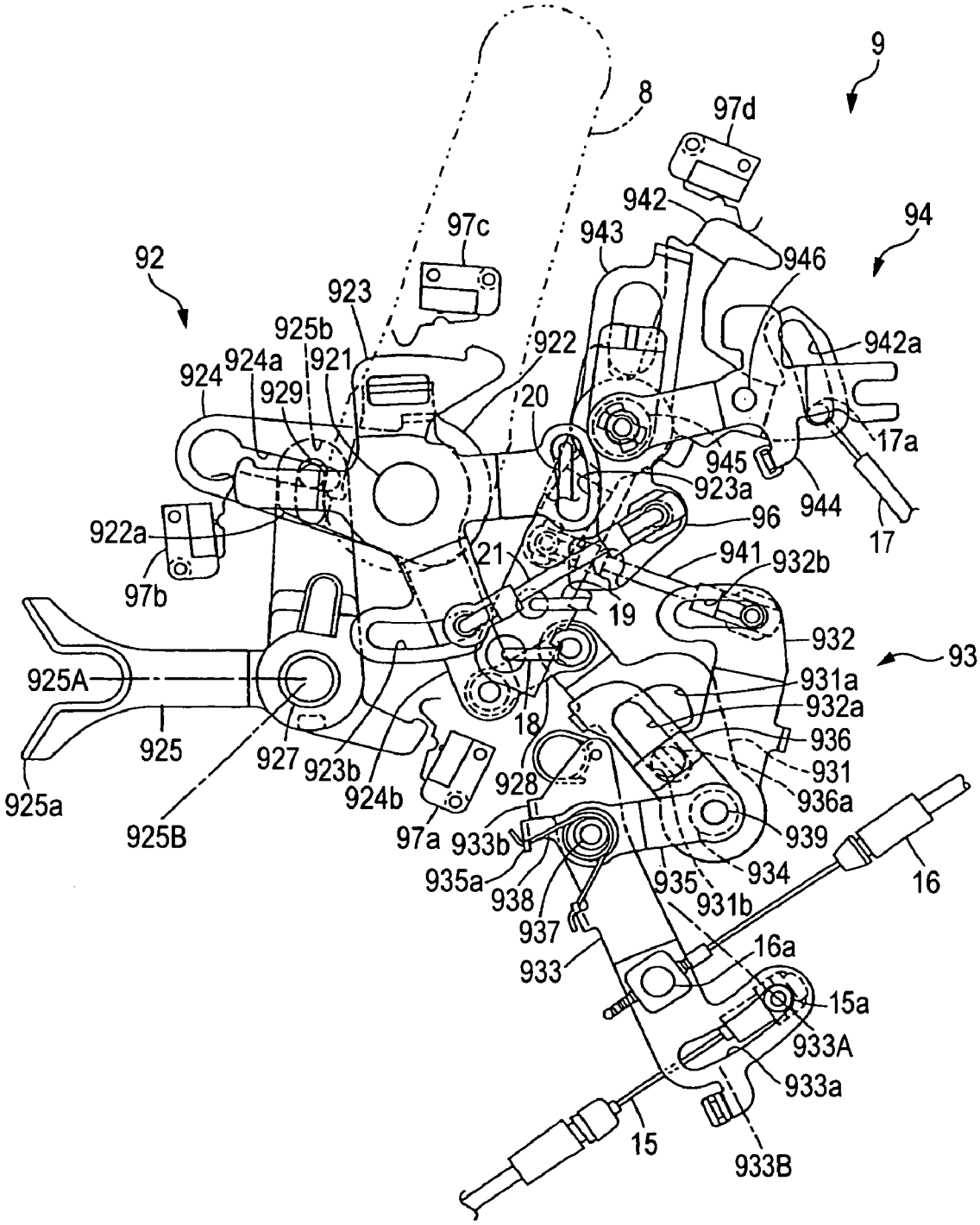
FIG. 4 is an explanatory drawing of the operation of a control unit when a first childproof safety lock unit and a second childproof safety lock unit are both in unlocking states.

As a result, as shown in FIG. 4, the door opening control force inputted into the second input lever (931) of the second childproof safety lock unit (93) and is then transmitted to the third input lever (942) and the third output lever (943) of the locking/unlocking unit (94) via the second output lever (932). In addition, at the same time as this occurs, since the output signal of the door opening control detection sensor (97*b*) becomes HIGH based on the door opening operation of the first input lever (922), the motor (141) of the first actuator (14) is controlled to be driven to rotate normally. Accordingly, the unlocking release lever (14*a*) of the first actuator (14) is activated, and power thereof is then transmitted to the third input lever (942) via the cable (17). By virtue of this, the power of the first actuator (14) is made to assist the door opening control force of the inner handle (8), whereby the respective total closing latches (10), (11) are activated to be released, and thus, the sliding door (1) can be opened.

After the respective total closing door latches (10), (11) have been released from the latching states, the latch release detection sensor (97*d*) outputs a HIGH signal based on the door opening operation of the third input lever (942), and the motor (61) of the door opening/closing drive unit (6) is controlled to be driven to rotate normally, whereby the sliding door (1) is moved towards the totally opened position by power of the motor (61).

(B. A case where the vehicle runs with the first childproof safety lock unit (92) in the unlocking state (refer to FIGS. 5, 6 and the regions (a), (b) in FIG. 12))

Figure 5:
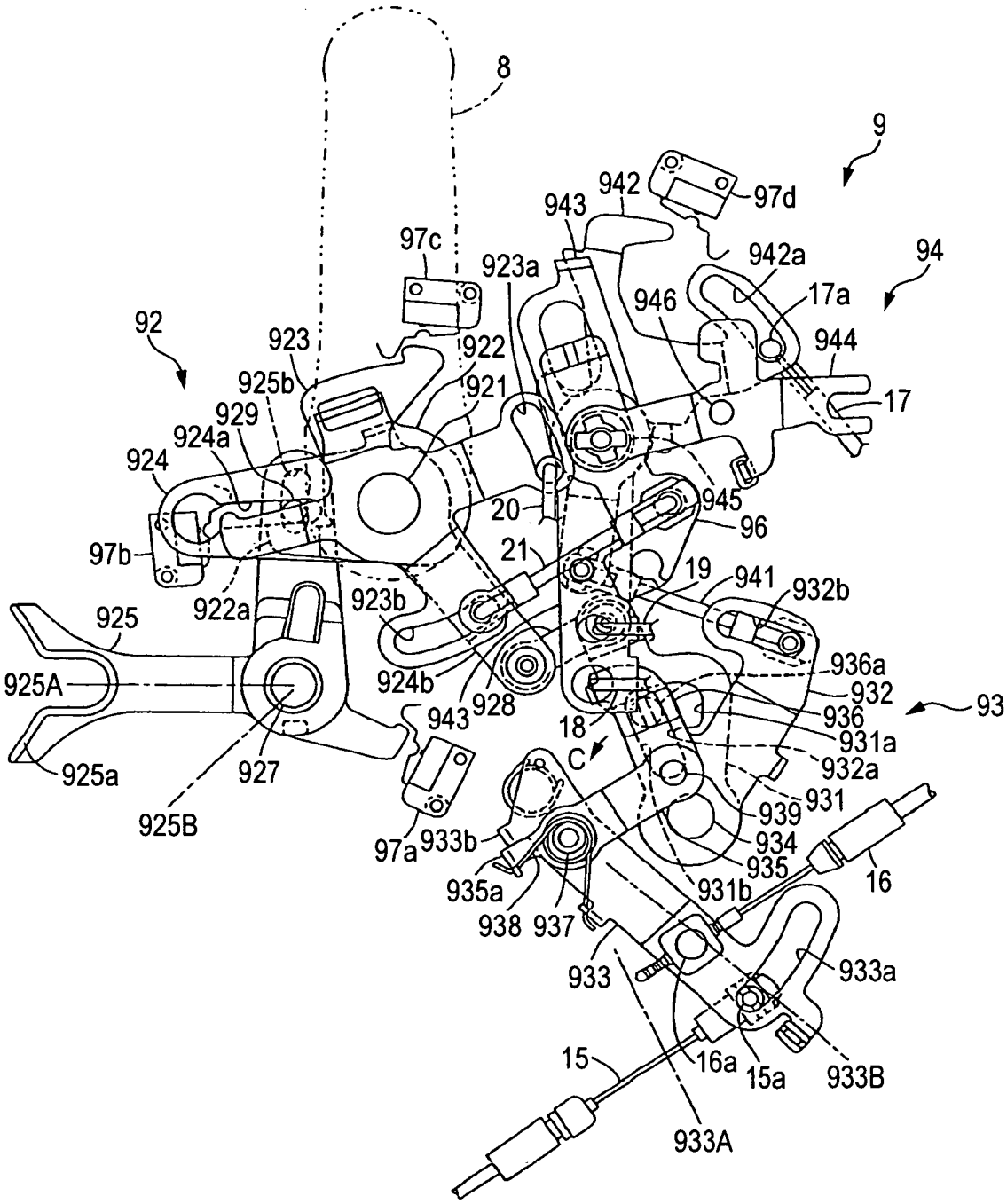
FIG. 5 is an explanatory drawing of the operation of the control unit when the first childproof safety lock unit is in the unlocking state and the second childproof safety lock unit is in a locking state.

When the vehicle speed sensor detects the running of the vehicle and outputs a HIGH (vehicle running) signal, the motor (141) of the first actuator (14) is controlled to be driven to rotate reversely (locking drive control) on this occasion to thereby activate the locking lever (14*b*), whereby as shown in FIG. 5, the second childproof safety lock unit (93) is displaced from the unlocking state to the locking state via the cable (16).

Figure 6:
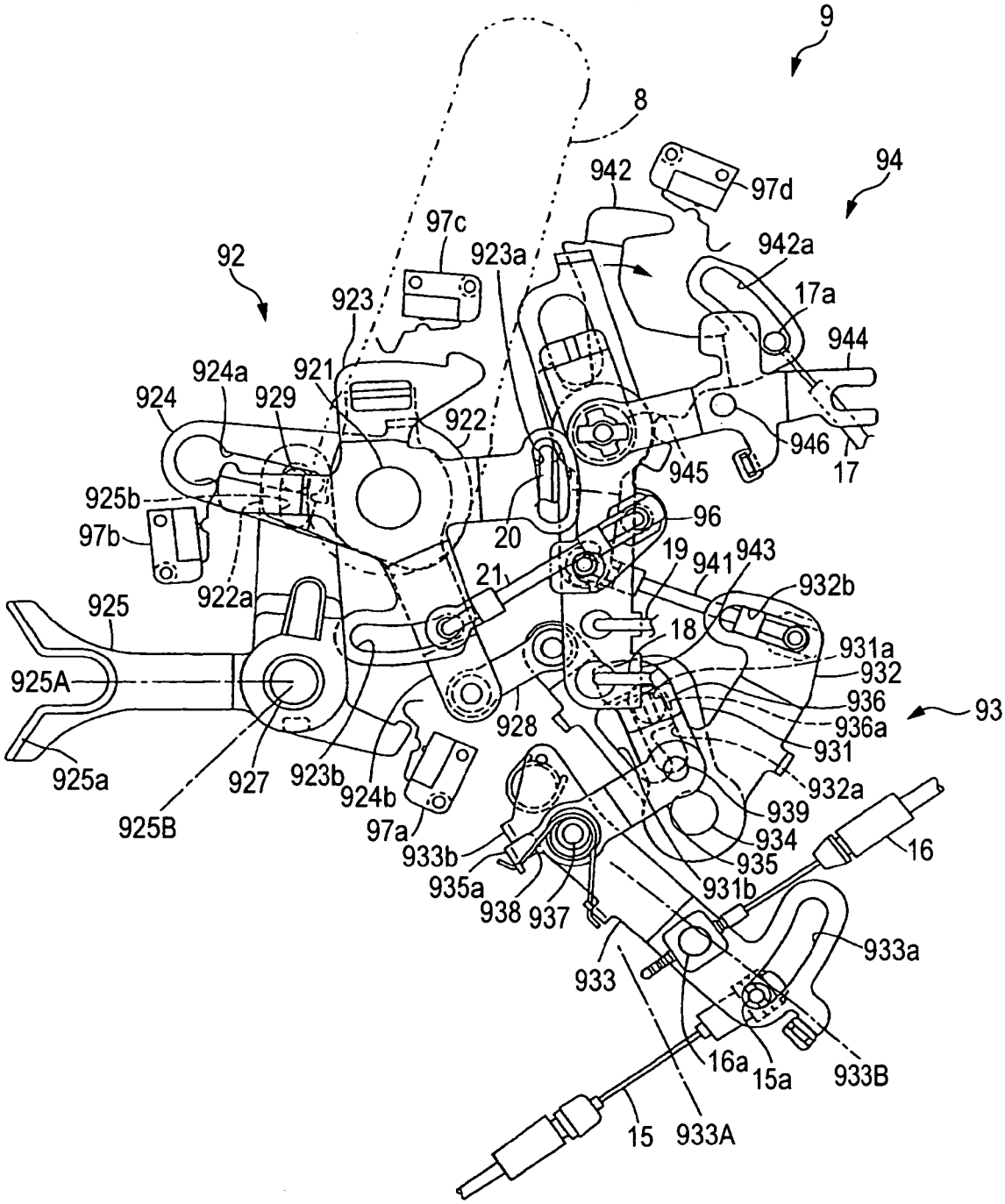
FIG. 6 is an explanatory drawing of the operation of the control unit when an inner handle is controlled to open a door with the first childproof safety lock unit in the unlocking state and the second childproof safety lock unit in the locking state while the vehicle is running.

In this state, since the second childproof safety lock unit (93) is in the locking state even when the first childproof safety lock unit (92) is in the unlocking state, when the inner handle (8) is controlled to open the door as shown in FIG. 6, the control force of the inner handle (8) is transmitted to the second input lever (931) of the second childproof safety lock unit (93) via the first childproof safety lock unit (92). However, since the control force is not transmitted to the second outlet lever (932), the respective total closing door latches (10), (11) cannot be released from the latching state. In addition, since the output signal of the vehicle speed sensor (101) is HIGH, even in the event that the output signal of the door opening control detection sensor (97*b*) becomes HIGH, the motor (141) of the first actuator (14) is not controlled to be driven.

Due to this, even in the event that the driver or occupant fails to perform a lock control on the first childproof safety lock unit (92), the second childproof safety lock unit (93) is displaced to the locking state when the vehicle starts running. Therefore, even in the event that the inner handle (8) is controlled to open the door as a result of the mishandling thereof or mischievous play therewith, the sliding door (1) cannot be opened, thereby making it possible to ensure the prevention of opening of the door due to the mishandling of the handle.

(C. A case where the vehicle starts running and then stops with the first childproof safety lock unit (92) in the unlocking state)

Since only the detection of the stopping of the vehicle does not always mean that a rear seat occupant intends to get out of the vehicle, the second childproof safety lock unit (93) is held in the locking state. In addition, also when the vehicle starts running in this state, the second childproof safety lock unit (93) is held in the locking state. Since this configuration prevents the first actuator (14) and the second childproof safety lock unit (93) from being activated every time the vehicle repeats running and stopping, useless operations and operating noises can be eliminated.

(D. A case where the inner handle (8) is controlled to open the door when the vehicle is at rest with the first childproof safety lock unit (92) in the unlocking state, the second childproof safety lock unit (93) in the locking state and the vehicle stopping signal (x) being LOW (refer to FIGS. 5, 6 and the region (c) in FIG. 12))

In this state, since the second childproof safety lock unit (93) is in the locking state even when the first childproof safety lock unit (92) is in the unlocking state, even in the event that the inner handle (8) is controlled to open the door, the control force thereof is not transmitted to the respective total closing door latches (10), (11). In addition, since the vehicle stopping signal (x) is LOW, that is, the vehicle is not at rest in a safety condition, even in the event that the door opening control detection sensor (97*b*) outputs a HIGH signal, the motor (141) of the first actuator (14) is not controlled to be driven. As a result, unless the vehicle is at rest in a safety condition, the sliding door (1) cannot be opened, and hence safety can be assured.

(E. A case where the inner handle (8) is controlled to open the door when the vehicle is at rest with the first childproof safety lock unit (92) in the unlocking state, the second childproof safety lock unit (93) in the locking state and the vehicle stopping signal (x) being HIGH (refer to FIGS. 6 to 8 and the region (d) in FIG. 12))

As shown in FIG. 6, the door opening control force of the inner handle (8) is transmitted into the second input lever (931) of the second childproof safety lock unit (93) from the first output lever (924) of the first childproof safety lock unit (92). As this occurs, since the second childproof safety lock lever (933) is in the locking position (933B) and the engagement portion (936*a*) of the second connecting lever (936) is situated within the arc-shaped hole portion (931*a*) of the second input lever (931) (the cutting-off position), only the second input lever (931) is operated in the door opening direction, and the engagement portion (936*a*) of the second connecting lever (936) is moved relatively rearwards in the arc-shaped hole portion (931*a*) of the second input lever (931).

In addition, at substantially the same time as this action or immediately thereafter, the output signal of the door opening control detection sensor (97*b*) becomes HIGH based on the control of the inner handle (8) to open the door, whereby the motor (141) of the first actuator (14) is driven to rotate normally (an unlocking drive control is performed).

Figure 7:
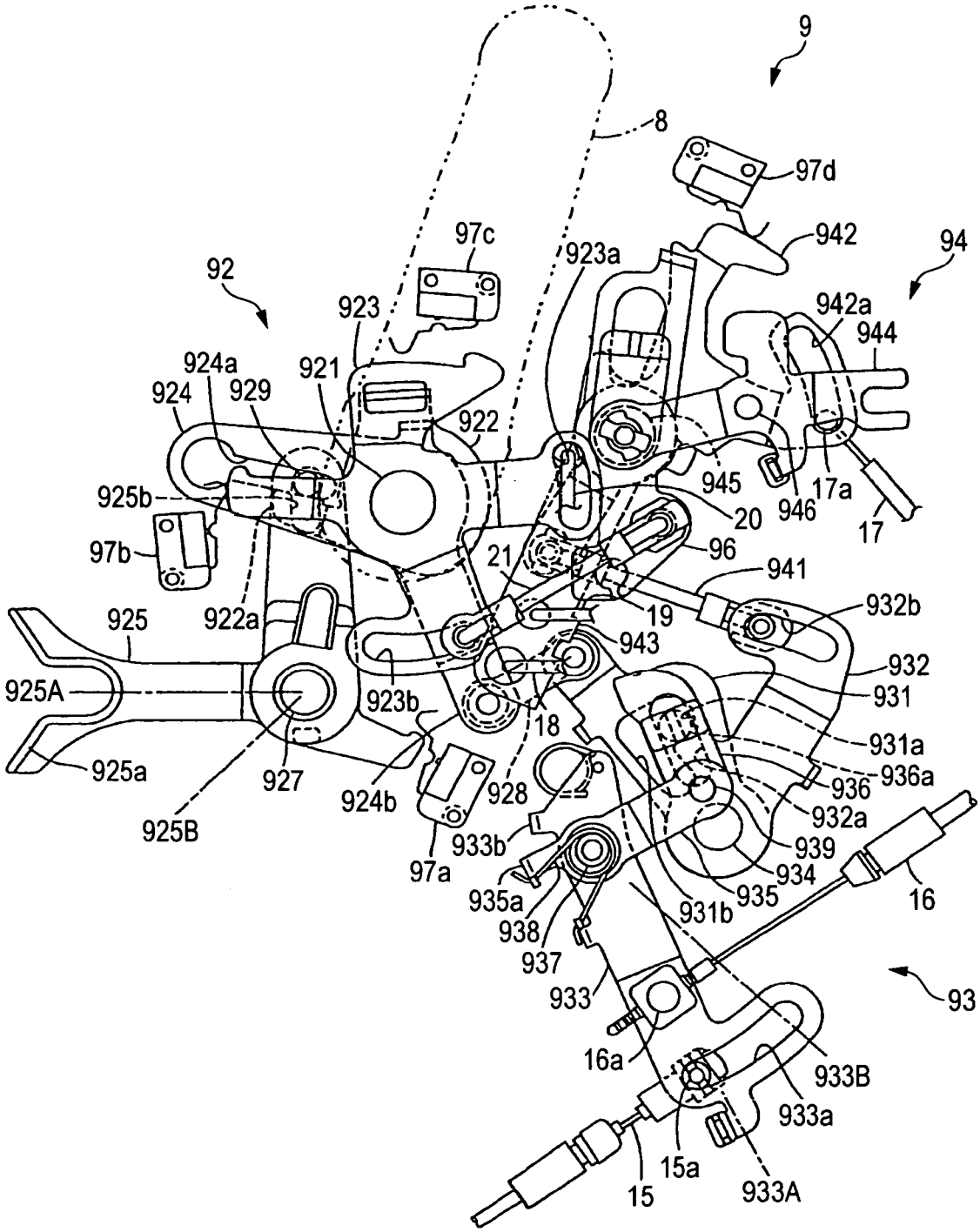
FIG. 7 is an explanatory drawing of the operation of the control unit when the inner handle is controlled to open the door with the first childproof safety lock unit in the unlocking state and the second childproof safety lock unit in the locking state while the vehicle is at rest.
Figure 8:
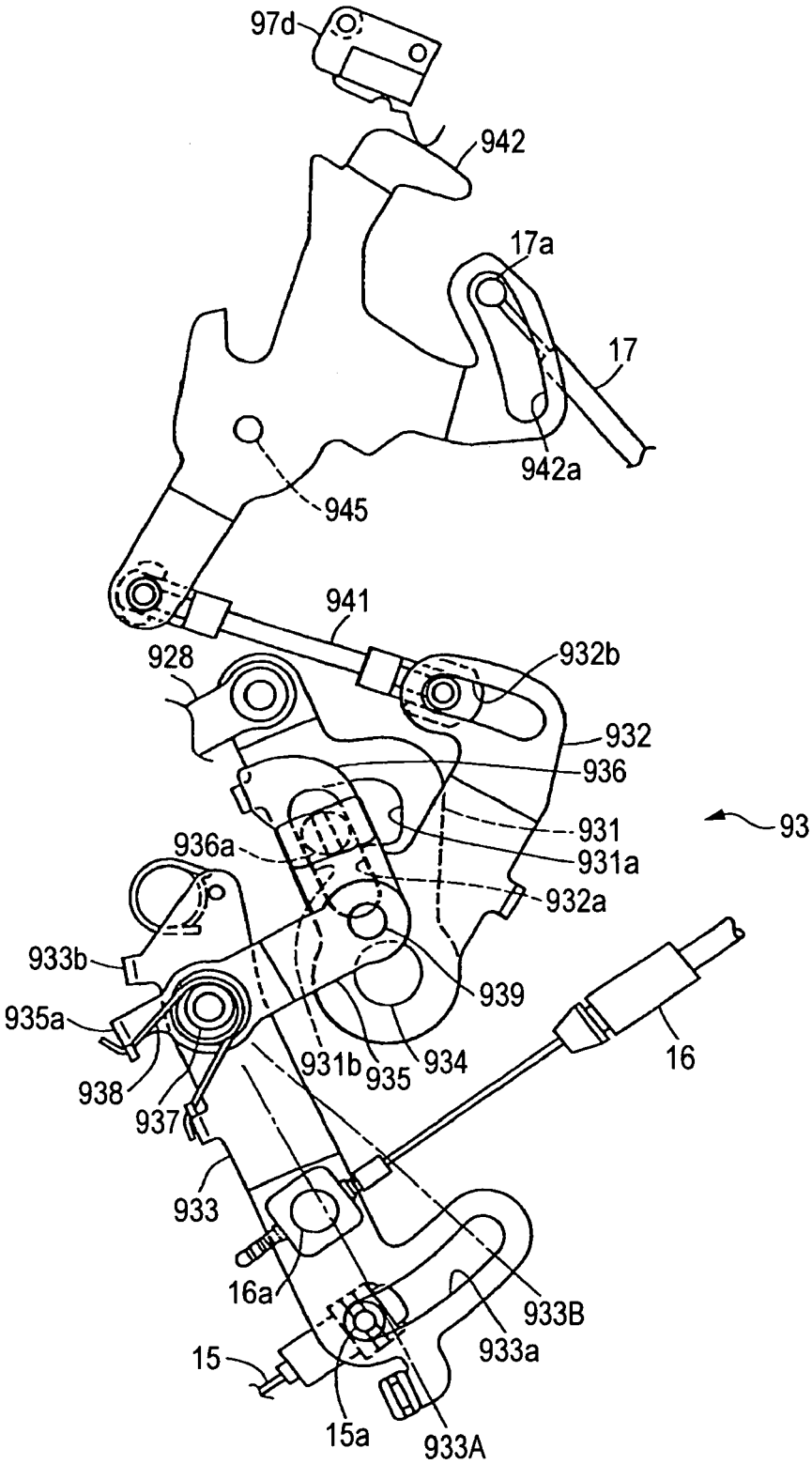
FIG. 8 is an explanatory drawing of the operation of the control unit with a main part thereof enlarged.

As a result, as shown in FIG. 7, the second childproof safety lock lever (933) of the second childproof safety lock unit (93) is moved from the locking position to the unlocking position via the cable (15) as the first actuator (14) is driven to rotate normally. As this occurs, since the engagement portion (936*a*) of the second connecting lever (936) is in engagement with the arc-shaped hole portion (931*a*), whereby the second connecting lever (933) is restrained from moving downwards (towards the connecting position), only the second childproof safety lock lever (933) moves from the locking position to the unlocking position against the biasing force of the spring (938) with the engagement portion (936*a*) of the second connecting lever (936) left in engagement with the arc-shaped hole portion (931*a*). Thereafter, when the door opening control force of the inner handle (8) is released and the second input lever (931) is restored to the waiting position as shown in FIG. 8, the engagement portion (936*a*) of the second connecting lever (936) is disengaged from the arc-shaped hole portion (931*a*) and is moved to a lower end (the connecting position) of the rectilinear hole portion (931*b*). As a result, the second childproof safety lock unit (93), whereby the displacement of the second childproof safety lock unit (93) to the unlocking state by the power of the first actuator (14) can be ensured by preventing the respective levers (931), (932) of the second childproof safety lock unit (93) from interfering with each other.

In addition, in parallel with this operation, the third input lever (942) of the locking/unlocking unit (94) is activated in the door opening direction via the cable (17) by the action of the unlocking release lever (14*a*) of the first actuator (14), and the respective total closing door latches (10), (11) are released from the latching states via the third output lever (943) and the cables (18), (19). Thereafter, when the latch release detection sensor (97*d*) outputs a HIGH signal, the motor (61) of the door opening/closing drive unit (6) is controlled to be driven to rotate normally, whereby the sliding door (1) is moved in the opening direction.

By this operation, the unlocking control of the second childproof safety lock unit (93) and latching releasing control of the respective total closing door latches (10), (11) can be performed altogether based on the door opening control of the inner handle (8). In addition, by completing the release of the respective total closing door latches (10), (11) at one time by controlling the inner handle (8) to open the door, a latch releasing force which needs to be exerted by the inner handle (8) is reduced, the controllability being thereby enhanced.

(F. A case where the first childproof safety lock unit (92) is in the locking state, whereas the second childproof safety lock unit (93) is in the unlocking state (refer to FIGS. 9, 10 and the region (f) in FIG. 12))

Figure 9:
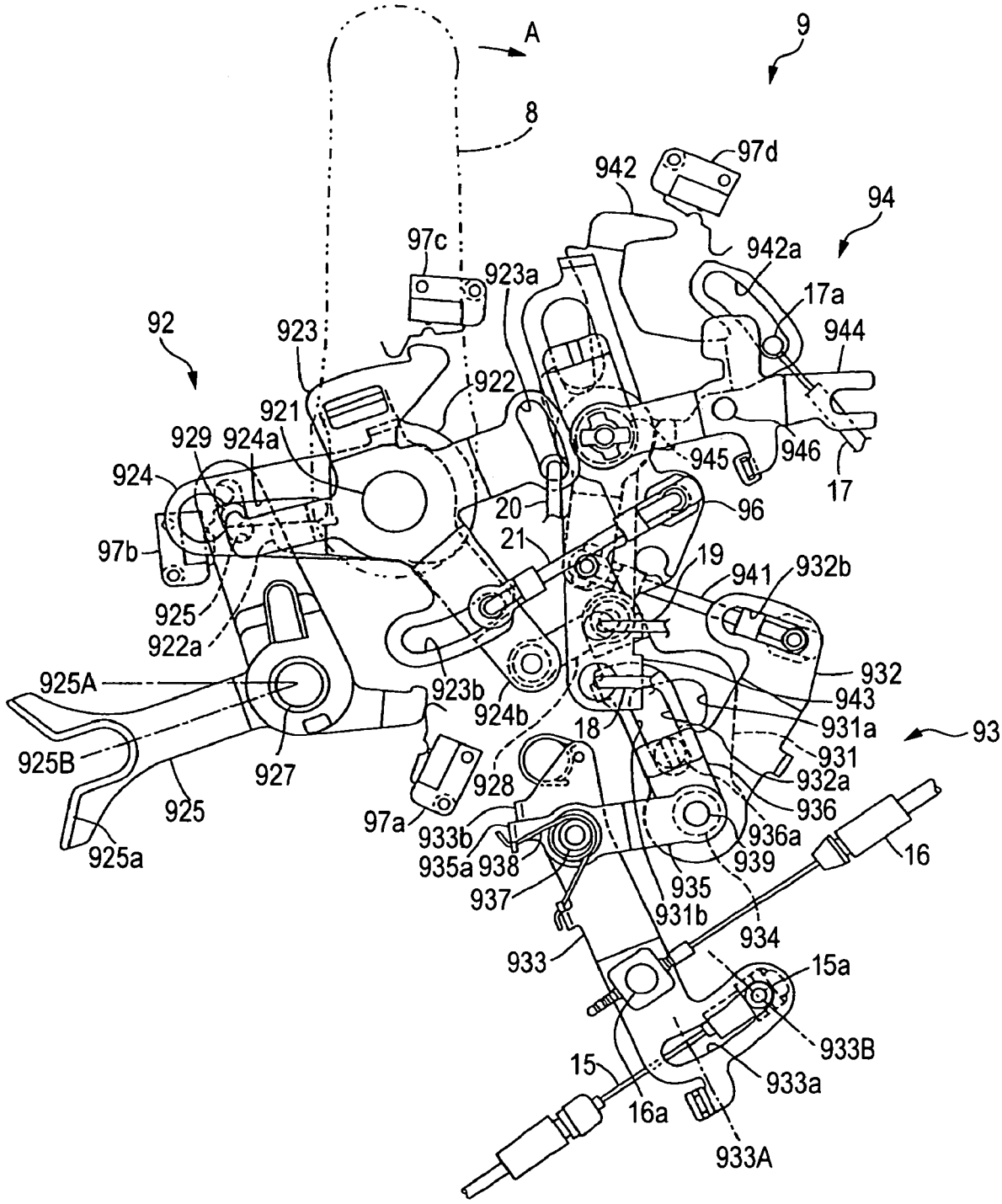
FIG. 9 is an explanatory drawing of the operation of the control unit when the first childproof safety control unit is in the locking state and the second childproof safety lock unit is in the unlocking state.
Figure 10:
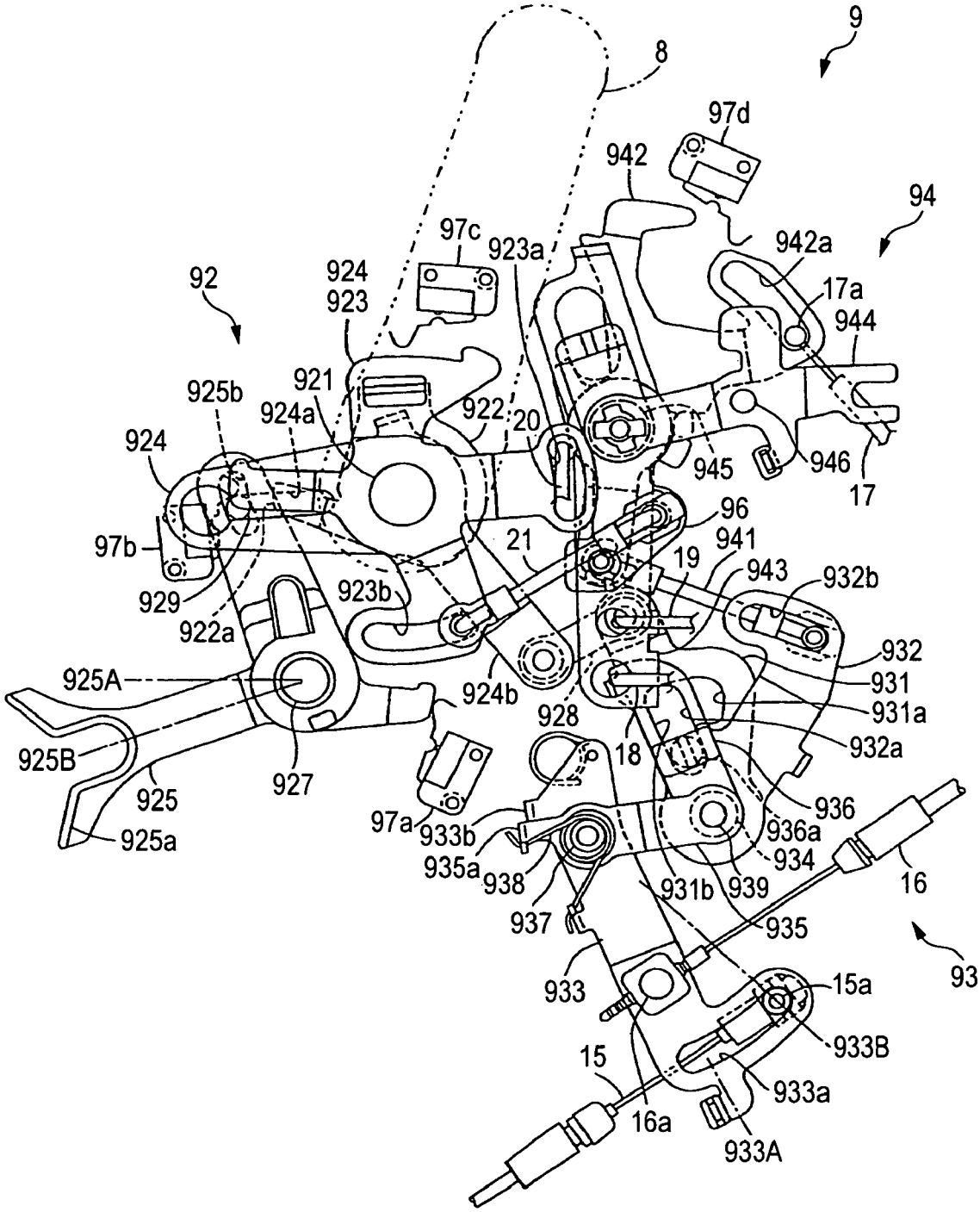
FIG. 10 is an explanatory drawing of the operation of the control unit when the inner handle is operated to open the door with the first childproof safety lock unit in the locking state and the second childproof safety lock unit in the locking unlocking state.

When the sliding door (1) is opened to control the manual control portion (925*a*) of the first childproof safety lock lever (925) of the first childproof safety lock unit (92) in a locking direction with the vehicle at rest, the first childproof safety lock unit (92) is displaced to the locking state as shown in FIG. 9. In this state, since the door opening control force of the inner handle (8) is cut off by the first childproof safety lock unit (92) as shown in FIG. 10 even in the event that the inner handle (8) is controlled to open the door, the respective total closing door latches (10), (11) cannot be released from the latching states, and hence, the sliding door (1) cannot be opened.

When the first childproof safety lock unit (92) is brought into the locking state by controlling it manually before the vehicle starts running, a measure against mishandling of the inner handle (8) during driving is secured by the locking state of the first childproof safety lock unit (92). Consequently, in this event, even in case the vehicle speed sensor (101) detects the running speed of the vehicle, there is no need to bring the second childproof safety lock (93) into the locking state.

Thus, as has been described heretofore, in the invention, there are provided the first childproof safety lock unit (92) which can be displaced to the unlocking state where the first childproof safety lock unit can transmit the door opening control force of the inner handle (8) provided inside of the vehicle and the locking state where the unit cannot transmit the door opening control force and the second childproof safety lock unit (93) which can input thereinto the door opening control force transmitted from the first childproof safety lock unit (92) when the first childproof safety lock unit (92) is in the unlocking state and which can be displaced to the unlocking state where the second childproof safety lock unit (93) can transmit the door opening control force that the unit (93) has inputted thereinto to the respective total closing door latches (10), (11) which hold the sliding door (1) in the closed position and the locking state where the second childproof safety control unit (93) cannot transmit the door opening control force, whereby the second childproof safety lock unit (93) is made to be displaced to the respective states by virtue of the power of the first actuator (14) while the first childproof safety lock unit (92) is made to be manually displaced to the respective states, and by this configuration, the sliding door (1) does not have to be opened every time the childproof safety lock is controlled, thereby making it possible to realize the enhancement of the controllability of the childproof safety lock control apparatus. In addition, since the first childproof safety lock unit (92) can be controlled manually, not only can the enhancement in controllability of the apparatus be realized but also the manual control with small force becomes possible without being subjected to resistance resulting when the drive unit is reversed.

Further, in the invention, by linking the first actuator (14) which makes up the drive unit to the second childproof safety lock unit (93) and the respective total closing door latches (10), (11) in such a manner that not only the second childproof safety lock unit (93) is displaced from the locking state to the unlocking state but also the respective total closing door latches (10), (11) are released from the latching states when the first actuator (14) is driven to rotate normally (activation in the one direction), whereas when the first actuator (14) is driven to rotate reversely (the activation in the other direction), the second childproof safety lock unit is displaced from the unlocking state to the locking state, the control of the second childproof safety lock unit (93) and the release of the respective total closing door latches (10), (11) from the latching states can be completed by only the first actuator (14), thereby making it possible to realize a reduction in production costs.

Further, in the invention, since the total closing door latches (10), (11) can be released from the latching states by the power of the first actuator (14) which can be driven as the inner handle (8) is controlled to open the door at substantially the same time as the second childproof safety lock unit (93) is displaced from the locking state to the unlocking state, even in the event that the second childproof lock unit (93) is in the locking state, the displace of the second childproof safety lock unit (93) to the unlocking state and the release of the total closing door latches (10), (11) from the latching states can be completed at substantially the same time through the single control of the inner handle (8) to open the door, whereby the door can be opened quickly.

Thus, while the embodiment of the invention has been described heretofore, the following various modifications and alterations can be made to the embodiment without departing from the spirit and scope of the invention.

(i) As the door (1), in place of the sliding door, a side swing door or a tailgate may be used.

(ii) The power of the first actuator (14) is provided by any other means than the motor. An actuator for displacing the second childproof safety lock unit (93) to the respective states and an actuator for releasing the respective total closing door latches (10), (11) from the latching states are configured separately.

(iii) The control unit is configured so as to omit the locking/unlocking unit (94), and the door opening control force of the outer handle (7) is designed to be inputted into the second input lever (the input lever) (931) of the second childproof safety lock unit (93). According to this configuration, the second childproof safety lock unit (93) is made to have a similar function to that of the locking/unlocking unit (94), and the door opening control force inputted into the second input lever (931) is transmitted from the second output lever (932) (the output lever) directly or indirectly to the respective total closing door latches (10), (11).

(iv) In (iii) above, with the second childproof safety lock unit (93) in the locking state, when the door is handled from the outside of the vehicle or the outer handle (7) is controlled to open the door, the door opening control over the outer handle (7) is made available to only a specific controller who carries a transmitter which normally transmits a specific signal. To be specific, the first actuator (14) is made to be driven to rotate normally in association with the control of the outer handle (7), which makes up the control handle, to open the door only when a receiver installed on the vehicle receives the specific signal transmitted by the transmitter carried by the controller, so that the displacement of the second childproof safety lock unit (93) from the locking state to the unlocking state and the release of the respective total closing door latches (10), (11) are completed by the power of the first actuator (14), so that the door can be opened. In addition, the inner handle (8) is to be controlled to open the door in the similar manner to that described in the embodiment above.

(v) The first childproof safety lock unit (92) is made to be displaced to the respective states by the power of the drive unit, while the second childproof safety lock unit (93) is made to be displaced to the respective states through manual control.

What is claimed is:

1. An automotive childproof safety lock control apparatus, comprising:

a first childproof safety lock unit configured to assume an unlocking state and a locking state and configured to transmit a door opening control force applied by an inner handle provided inside a vehicle, only in the unlocking state;

a second childproof safety lock unit configured to assume an unlocking state and a locking state and configured to input thereinto the door opening control force transmitted from the first childproof lock unit and to transmit the door opening control force which it has inputted thereinto, only in the unlocking state;

a door latch configured to hold a door in a closed position and configured to receive the transmitted door opening control force from the second childproof safety unit;

a drive unit configured to supply power to either the first or second childproof safety lock unit to be displaced to the respective states; and a childproof safety lock lever configured to be manually operated to displace the other of the first or the second childproof safety lock unit in the respective states.

2. An automotive childproof safety lock control apparatus, comprising:

a first childproof safety lock unit configured to assume an unlocking state and a locking state and configured to transmit a door opening control force applied by an inner handle provided inside a vehicle, only in the unlocking state;

a second childproof safety lock unit configured to assume an unlocking state and a locking state and configured to input thereinto the door opening control force transmitted from the first childproof lock unit and to transmit the door opening control force which it has inputted thereinto, only in the unlocking state;

a door latch configured to hold a door in a closed position and configured to receive the transmitted door opening control force from the second childproof safety unit;

a drive unit configured to perform an unlocking drive and a locking drive to displace either the first or second childproof safety lock unit to the unlocking state and the locking state, respectively;

a door opening control detecting unit configured to detect a door opening control performed by the inner handle;

a control unit configured to execute a locking drive control of the drive unit based on a vehicle running signal and an unlocking drive control of the drive unit based on detection of the door opening control by the door opening control detecting unit; and a childproof safety lock lever configured to be manually operated to displace the other of the first or second childproof safety lock unit in the respective states.

3. The automotive childproof safety lock control apparatus according to claim 2, wherein the control unit is configured not to execute the unlocking drive control of the drive unit while the vehicle running signal is being inputted.

4. The automotive childproof safety lock control apparatus according to claim 2, wherein the control unit is configured to enable the unlocking drive control of the drive unit while a vehicle stop signal is being inputted thereinto.

5. The automotive childproof safety lock control apparatus according to claim 2, wherein the control unit is configured not to execute the unlocking drive control of the drive unit while a locking state detection signal of either the first or second childproof safety lock unit is being inputted, while the vehicle running signal is inputted thereinto.

6. An automotive childproof safety lock control apparatus, comprising:

a door latch configured to hold a door of a vehicle in a closed position in a latching state;

a first childproof safety lock unit having a first childproof safety lock lever configured to manually assume an unlocking and a locking state;

a second childproof safety lock unit having a first childproof safety lock lever configured to assume an unlocking state where releasing the door latch from the latching state is enabled by controlling an inner handle provided inside of the vehicle to open the door and a locking state where releasing the door latch from the latching state is disabled; and a drive unit which is linked to the second childproof safety lock unit and the door latch in such a manner as to electronically displace the second childproof safety lock lever from the locking state to the unlocking state and release the door latch from the latching state when activated in one direction and to electronically displace the second childproof safety lock lever from the unlocking state to the locking state when activated in the other direction.

7. The automotive childproof safety lock control apparatus according to claim 6, wherein when the first childproof safety lock lever is in the unlocking state, the drive unit is activated in the one direction so as to electrically displace the second childproof safety lock lever to the unlocking state and to release the door latch as the inner handle is controlled to open the door.

8. An automotive door latch control apparatus, comprising:

a lock unit configured to assume an unlocking state where the lock unit can transmit a door opening control force applied by a control handle provided on a door to a door latch and a locking state where the lock unit cannot transmit the door opening control force, wherein the door latch is configured to be released from a latching state by power of a drive unit which can be driven as the control handle is controlled to open the door at substantially the same time as the lock unit is displaced from the locking state to the unlocking state, the lock unit comprising:

an input lever configured to input thereinto the door opening control force of the control handle;

an output lever configured to be linked to the door latch;

a connecting unit configured to assume a connecting position and a cutting-off position, the connecting unit being configured to transmit the door opening control force that the input lever has inputted thereinto to the output lever only in the connecting position; and a lock lever configured to be moved by power of a drive unit to an unlocking position where the connecting unit can be held in the connecting position and a locking position where the connecting unit is held in the cutting-off position, and wherein, when the door opening control force is inputted into the input lever in such a state that the lock lever is in the locking position and the connecting unit is in the cutting-off position, the lock lever is moved to the unlocking position against a biasing force exerted between the connecting unit and the lever by power of the drive unit with the connecting unit held in the cutting-off position, and when the door opening control force is removed, the connecting unit is moved to the connecting position by the biasing force, so that the lock unit is displaced to the unlocking state.

9. An automotive childproof safety lock control apparatus, comprising:

a first childproof safety lock unit configured to assume an unlocking state and a locking state and configured to transmit a door opening control force applied by an inner handle provided inside a vehicle, only in the unlocking state;

a second childproof safety lock unit configured to assume an unlocking state and a locking state and configured to input thereinto the door opening control force transmitted from the first childproof lock unit and to transmit the door opening control force which it has inputted thereinto, only in the unlocking state; and a door latch configured to hold a door in a closed position and configured to receive the transmitted door opening control force from the second childproof safety unit.

10. The automotive childproof safety lock control apparatus according to claim 9, further comprising a drive unit configured to perform an unlocking drive and a locking drive to displace either the first or second childproof safety lock unit to the unlocking state and the locking state, respectively.

11. The automotive childproof safety lock control apparatus according to claim 10, further comprising a control unit configured to execute a locking drive control of the drive unit based on a vehicle running signal.

12. The automotive childproof safety lock control apparatus according to claim 11, wherein the control unit is configured not to execute the unlocking drive control of the drive unit while the vehicle running signal is being inputted.

13. The automotive childproof safety lock control apparatus according to claim 10, further comprising a control unit configured to execute an locking drive control of the drive unit based on a door opening signal.

14. The automotive childproof safety lock control apparatus according to claim 13, wherein the control unit is configured to enable the unlocking drive control of the drive unit while a vehicle stop signal is being inputted thereinto.

* * * * *